US005498068A

United States Patent [19]

Putzer et al.

[11] Patent Number: 5,498,068

[45] Date of Patent: Mar. 12, 1996

[54] NON-ENTRY MINING METHOD EQUIPMENT

[75] Inventors: Rüdiger Putzer, Ahornweg, Germany; Jean L. Narcy, Saskatoon, Canada

[73] Assignee: Ingersoll-Rand Company, Woodcliff Lake, N.J.

[21] Appl. No.: 388,338

[22] Filed: Feb. 14, 1995

[51] Int. Cl.[6] ..... F21C 25/60; F21C 45/00

[52] U.S. Cl. ..... 299/17; 175/67; 299/56; 299/81.3

[58] Field of Search ..... 299/17, 56, 81; 175/67, 424

[56] References Cited

U.S. PATENT DOCUMENTS 1,935,643 11/1933 Laughlin ..... 299/17 X
4,921,306 1/1990 Tomlin ..... 299/81 X
5,255,959 10/1993 Loegel ..... 299/17

FOREIGN PATENT DOCUMENTS 217272 1/1985 Germany ..... 299/17

*Primary Examiner*—David J. Bagnell
*Attorney, Agent, or Firm*—John J. Selko

[57] ABSTRACT

A jet boring pre-assembly for excavating an underground area susceptible to disaggregation and for control from a working gallery below the area includes a cutting head for the top of the assembly, the cutting head having separate conduits for delivery of high pressure cutting fluid to high pressure nozzles, and a low pressure flushing fluid to flushing nozzles. A dual conduit drilling rod is located in a borehole beneath the cutting head, the rod having separate conduits for delivery of the high pressure and low pressure fluids to the cutting head. A preventor box below the cutting head seals the borehole and transmits slurry of excavated material to an outlet.

18 Claims, 5 Drawing Sheets

NON-ENTRY MINING METHOD EQUIPMENT

BACKGROUND OF THE INVENTION

The present invention relates to a method of excavating an underground area from a working gallery beneath the area for excavation. The equipment of the invention is specially adapted to allow for excavation without human intervention in the excavation area, thereby allowing for the excavation of a hazardous area without exposing humans to the hazards.

The equipment of the invention represents a novel adaption of jet boring technology. Thus its use is confined to excavations of underground areas that are susceptible to disaggregation by high pressure jetting action. Such areas tend to have weak goetechnical characteristics, and may be prone to cave-in or flooding during excavation. Additionally, the equipment of the invention would only be for use when it is considered to be advantageous to access the excavation area from below rather than directly from the surface. For example, access from the surface may be particularly difficult if the area for excavation underlies a lake which imposes high hydrostatic pressure on the area.

SUMMARY OF THE INVENTION

The invention provides for a jet boring pre-assembly for assembly and use in excavating an underground area susceptible to disaggregation by high pressure fluid jet, such as a water jet. The assembly is controlled from a working gallery below the area. The pre-assembly comprises a cutting head for a top of the assembly which has a jet boring fluid conduit for delivery of high pressure fluid to at least one jet boring fluid nozzle. There is also a flushing fluid conduit for delivery of low pressure flushing fluid to at least one flushing fluid nozzle. Preferably, the cutting head includes a plurality of augers adapted to assist movement of a slurry of disaggregated material and flushing fluid into the borehole when the augere are in flight during rotation of the cutting head. Further preferably, the cutting head is adapted to support a cutting bit, such as a tricone, for mechanical action.

The pre-assembly also includes a dual conduit drilling rod for location in a borehole beneath the cutting head. The rod has a jet boring fluid conduit for delivery of the high pressure fluid to the jet boring fluid conduit of the cutting head, and a flushing fluid conduit for delivery of the low pressure flushing fluid conduit of the cutting head.

The pre-assembly further includes a preventor box for sealing a lower end of the borehole and having a passage therethrough for the drilling rod. The preventor box includes sealing means for between an inner wall of the preventor box and an outer wall of the drilling rod whereby the drilling rod may be operated while maintaining a seal of the sealing means. There is also means for receiving a slurry of excavated material and flushing fluid from the borehole, and an outlet for the slurry. The sealing means preferably comprises a lower bushing and an upper retainer/guide bushing, and a seal between the lower and upper bushings. The upper bushing is preferably adapted at an upper surface thereof to assist flow of the slurry into the slurry outlet. Preferably the upper surface of the upper bushing is inclined towards the slurry outlet. The lower bushing is preferably a piston-type bushing for selective transverse movement by action of associated tightener means, eg. bolts. The preventor box may include a sealing fluid delivery means for delivery of sealing fluid to the sealing means and outer surface of the drilling rod. Preferably the seal comprises a plurality of compressible seal segments. Optionally a booster fluid inflow conduit is provided, adjacent an area of the preventor box for receiving the slurry, for delivery of booster fluid into the area to assist flow of the slurry into the slurry outlet.

The pre-assembly may also include a dual-conduit auger rod for use between the cutting head and the dual-conduit drilling rod. Such auger rod includes: a jet boring fluid conduit for delivering the high pressure fluid from the jet boring fluid conduit of the dual-conduit drilling rod to the jet boring fluid conduit of the cutting head; a flushing fluid conduit for delivering the low pressure flushing from the flushing fluid conduit of the dual-conduit drilling rod to the flushing fluid conduit of the cutting head and to at least one flushing fluid nozzle on the auger rod; and a plurality of augers adapted to assist movement of the slurring into the borehole when the augers are in flight during rotation of the auger rod.

Each nozzle may be located adjacent an auger and in such manner as to be protected from excessive abrasion when the augers are in flight during operation of the tool. In the case of a high pressure nozzle, this is also to maximize high pressure fluid action diameter, when said augers are in flight during operation of the tool.

The invention also provides for an assembly comprising the above described pre-assembly when assembled for use.

BRIEF DESCRIPTION OF THE FIGURES

Preferred embodiments of the invention are illustrated in the accompanying figures, in which.

DESCRIPTION OF THE PREFERRED EMBODIMENTS

Figure 1:
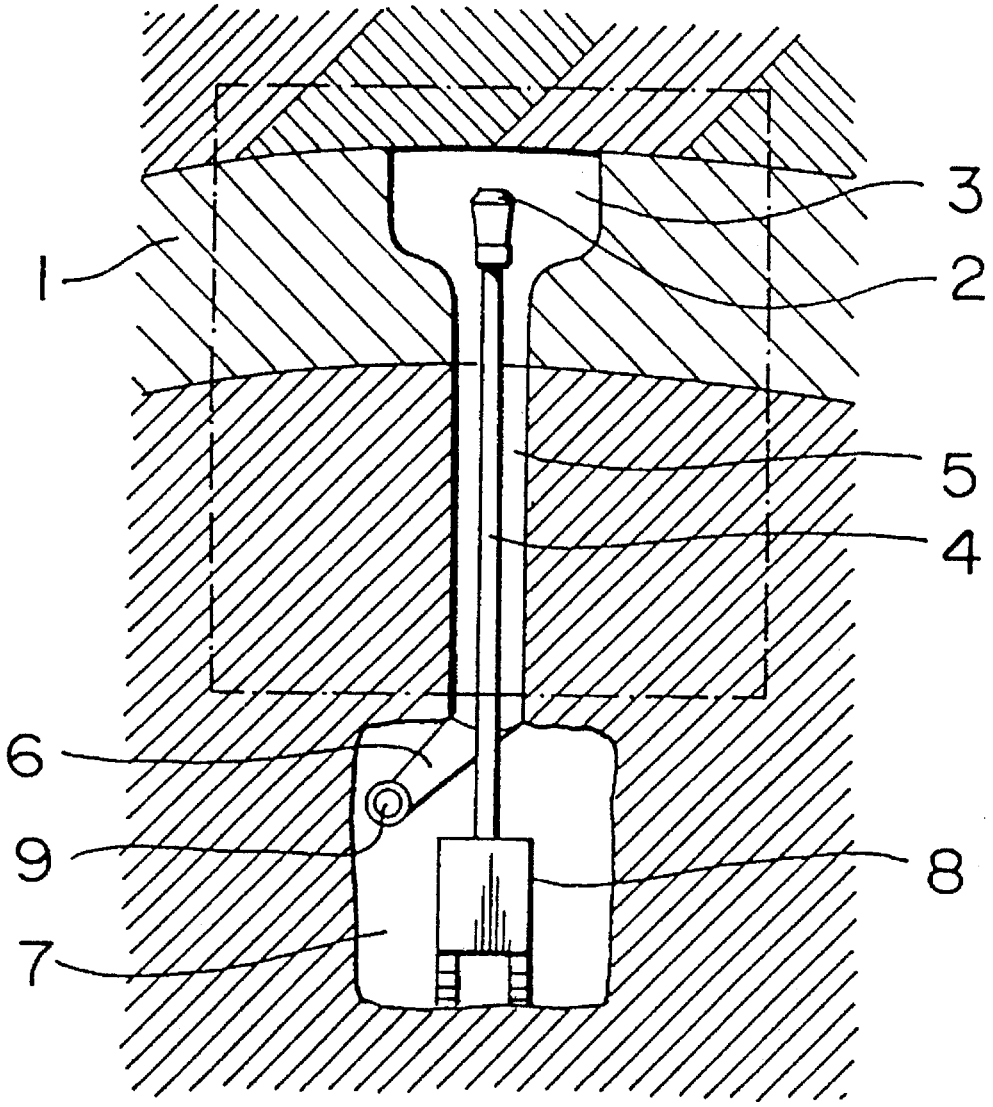
FIG. 1 is a cross-sectional view of an underground mining excavation showing a preferred application of the pre-assembly of the present invention when assembled for use.

FIG. 1 shows the pre-assembly of the present invention, when assembled to provide an excavation tool, in a preferred application, namely in excavating a mineral deposit 1 from an underground formation. There is shown a cutting head 2 in a formed cavity 3 of the formation, a drilling rod 4 beneath the cutting head and in a borehole 5, and a preventor box 6 beneath the drilling rod and adjacent a bottom of the borehole. There is also shown a working gallery 7 beneath the formation, from which the tool is controlled. A drive source 8 is provided for driving the drilling rod and cutting head.

It can be seen that material mined from the deposit flows under gravity from the cavity into the borehole along the outside of the drilling rod and into the working gallery. If the mineral under excavation is hazardous to humans, eg. if it is radioactive, then the material can be contained, while flowing, from the preventor box into a sealed conveyor 9 and to processing facilities at the surface. It is apparent that the assembly of the invention is specifically designed and intended for use in excavating from a working gallery below an area for excavation.

Figure 2:
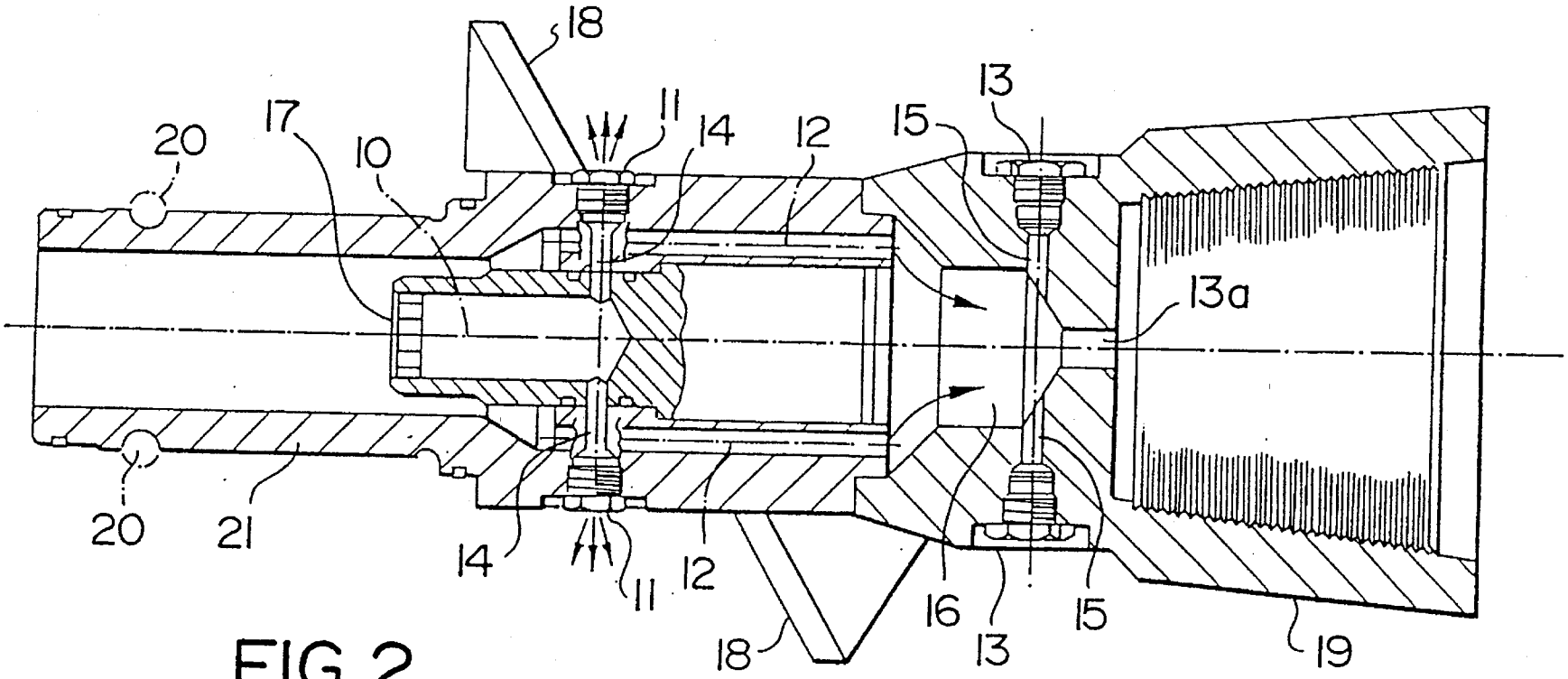
FIG. 2 is a cross-sectional view of a cutting head of the pre-assembly of the present invention.

In FIG. 2 there is shown a preferred cutting head of the pre-assembly and assembly of the invention, in which there is a high pressure, jet boring fluid conduit 10 for supplying jet boring fluid, preferably water, to a plurality of high pressure fluid nozzles 11. There is also a low pressure fluid conduit 12 around the jet boring fluid conduit for supplying flushing fluid, preferably water, to a plurality of low pressure flushing fluid nozzles 13, 13*a*. Note the high pressure fluid passages 14 between the inner jet boring fluid conduit 10 and the high pressure fluid nozzles 11, and the low pressure fluid passages 15 from the low pressure fluid conduit 16 to the flushing fluid nozzles 13. Retainer screen 17 is provided to screen out problematic particles from the high pressure fluid before the fluid reaches the nozzles, to prevent blockage. The jet boring fluid conduit 10 is for connection to a jet boring fluid conduit in an auger or drilling rod below by means of a slip-on stub connector.

In use the cutting head may be rotated by driving action applied to the drilling rod, which in turn drives the attached cutting head, thereby allowing augers 18 to assist in breaking down and moving chunks of material loosened by jetting action from the high pressure nozzles. The nozzles are preferably located adjacent the augers, ie. in the auger spiral, so that when the augers are in flight during operation the nozzles are somewhat protected from abrasion. High pressure nozzles so located will be also be more able to maintain an effective and maximum range of jetting fluid action, in that obstruction of the jetting action by chunks of loosened material will be minimized by the clearing action of the augers.

The preferred embodiment of FIG. 2 also shows a tricone connector 19, preferably threaded, for securing a tricone cutter, whereby the assembly in use may apply a mechanical cutting action. The flushing fluid nozzle 13*a* is for flushing material cut by the tricone.

Also shown in FIG. 2 are locking pins 20 and hexagonal connector 21. The hexagonal connector is for connecting the cutting head to a drilling or auger rod below. The hexagonal connector has, on its outer mating surface, a hexagonal shape in transverse cross-section, and is a male fitting for mating engagement with a female fitting, ie. a slip-on coupling, on an end of the rod below. The female fitting has on its inner mating surface a hexagonal shape in transverse cross-section. It will be appreciated that although the preferred embodiment provides for a male fitting at the hexagonal connector 21, this could be adapted to be a female fitting, ie. a slip-on coupling, if the fitting at the end of the rod below is also adapted to be a male fitting. In either configuration, the outer surface of the female fitting preferably is round in transverse cross-section; the hexagonal male/female fittings are inside. The hexagonal shape allows for a tight, non-slip seal at the coupling, ie. which is not prone to loosening and leakage compared to conventional cylindrical, or conical, threaded connectors. Also, the hexagonal connector allows auger rods to be connected in a series in a manner that results in the spirals of the auger rods forming a continuous and integral spiral line without interruptions. Furthermore, the hexagonal connector allows for torque transmission in either right-hand or left-hand rotation of the drilling rod, so as to allow for releasing jammed auger rods in the bore hole. Note that the locking pins hold the connector in the coupling. Although the preferred embodiment provides for a hexagonal connector, it will be apparent to a skilled person in the art that the shape of the mating surfaces of the connector, in transverse cross-section, may be octagonal, or any other reasonable non-circular shape that will prevent slippage in a slip-on coupling arrangement.

Figure 3:
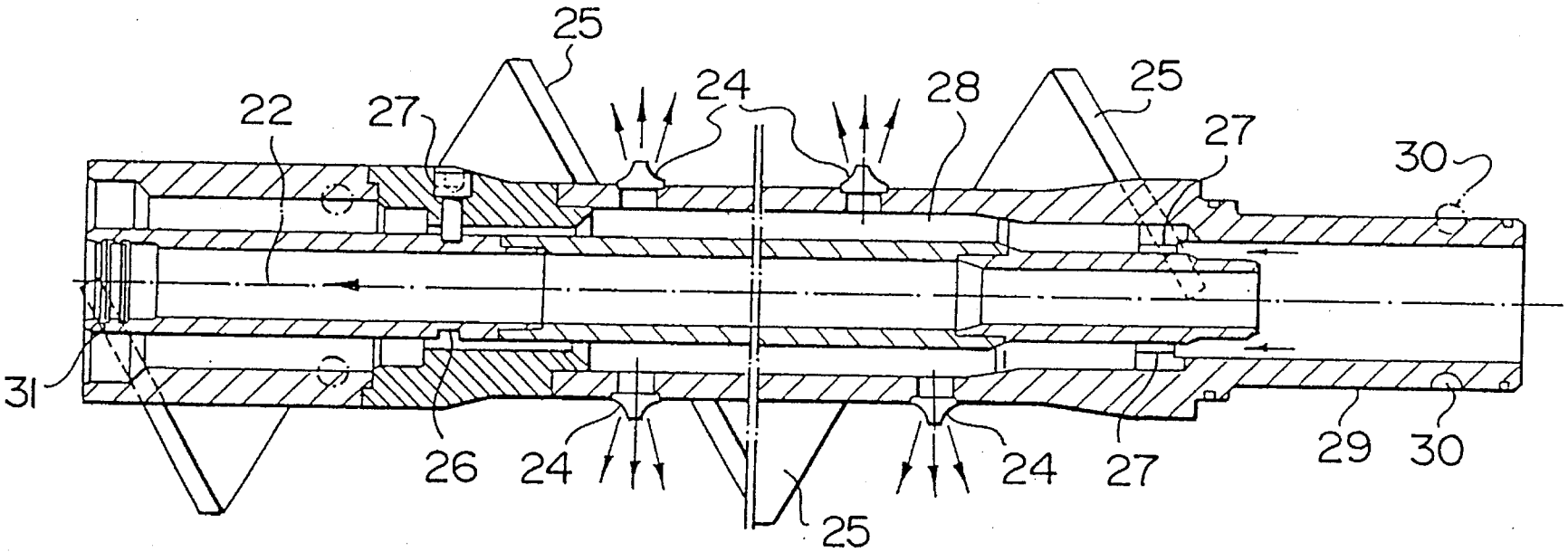
FIG. 3 is a cross-sectional view of an auger rod which may be included in the pre-assembly of the present invention.

FIG. 3 illustrates an optional auger rod for attachment to the cutting head. There is shown an inner high pressure, jet boring fluid conduit 22 and an outer low pressure flushing fluid conduit 28. These respectively are for engagement with the jet boring fluid conduit 10 and flushing fluid conduit 12 of the cutting head positioned above. Hexagonal connectors in slip-on couplings are used for connecting the casing of the flushing fluid conduit to casings of similar conduits in rods above and below. Slip-on stub connectors, which are circular in transverse cross-section, are used for connecting the casing of the jet boring fluid conduit to the casings of similar conduits in rods above and below. Flushing fluid nozzles 24 may be provided. Augers 25 are spaced on the auger rod and on the cutting head such that when the augers are in flight during rotation loosened material coming into contact with the augers is pushed along the outside of the head and rod, is towards the borehole. There is preferably no interruption in the regular spacing of the augers, eg. at the coupling between the cutting head and the auger rod, to interrupt the continuity of movement of loosened material.

FIG. 3 also shows spacer groove 26 and spacers 27 for positioning in adjacent spacer grooves, which in combination are spacing the inner, jet boring fluid conduit 22 from the inner walls of the outer, flushing fluid conduit 28. This prevents excessive transverse movements of the inner, jet boring fluid conduit from axial loads during operation, which might otherwise occur from rotation of the auger rod and the changeable high pressure load on the inside of the jet boring conduit. The spacers will nevertheless allow for slight compensating movements of the inner conduit.

FIG. 3 further shows a hexagonal connector 29 and connector pins 30 for making a slip-on coupling with an optional further auger rod or drilling rod. Female slip-on coupling 31 is provided at the other end of the auger rod for attachment to a male hexagonal connector of the cutter head or another auger rod.

Figure 4:
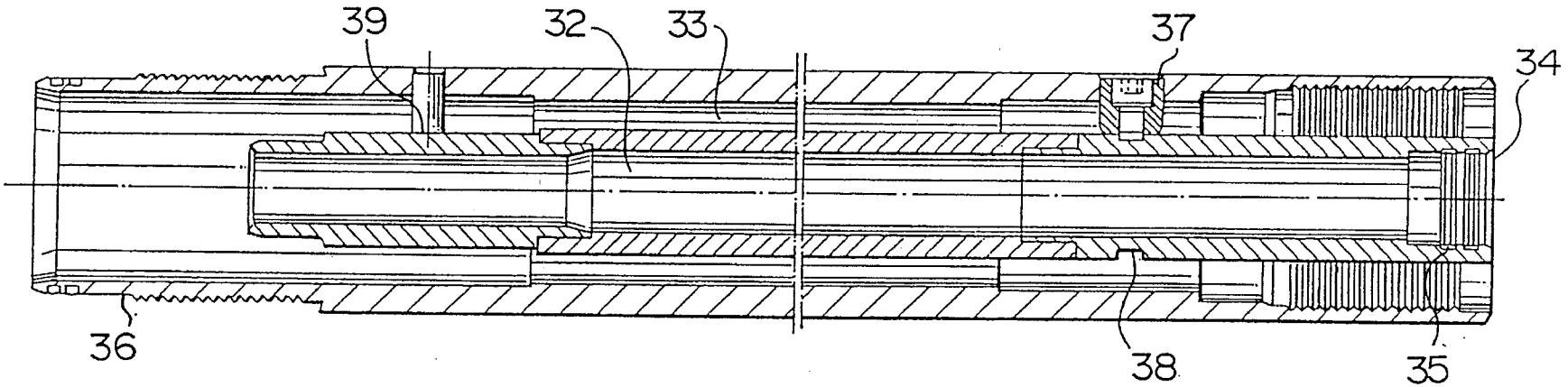
FIG. 4 is a cross-sectional view of a drilling rod of the pre-assembly of the present invention; and, FIG. 5 is a cross-sectional view of a preventor box of the pre-assembly of the present invention.

The drilling rod of FIG. 4 includes an inner jet boring fluid conduit 32 for connection by a slip-on stub connector with an inner jet boring fluid conduit to be positioned immediately above the drilling rod, whether the latter is in another length of similar drilling rod, or in the above described auger rod, or cutting head. There is also an outer flushing fluid conduit 33 which, likewise, is for connection with an outer flushing fluid conduit to be positioned immediately above in another length of similar drilling rod, or in the auger rod or cutting head. On one end of the drilling rod is a female screw coupling 34 with seals 35, and at the other end there is a male screw coupling 36, respectively for mating connection with another length of similar drilling rod. If a drilling rod is to be connected to an auger rod or cutting head above wherein a hexagonal connector is provided for, then the connecting end of the drilling rod must be adapted (not shown) to be a male or female, as appropriate, hexagonal connector fitting.

Note the spacer 37 and spacer groove 38 for receiving a spacer, which are also provided regularly along the drilling rod, eg. at 39. These have the same kind of function as the spacers and spacer grooves of the above described auger rod.

The inner jet boring fluid conduits and slip-on stub couplings are preferably made of stainless-steel, non-corrosive materials as, in a preferred application of the tool of the invention, corrosive hot water under very high pressure is used for cutting action against a frozen mineral deposit.

Figure 5:
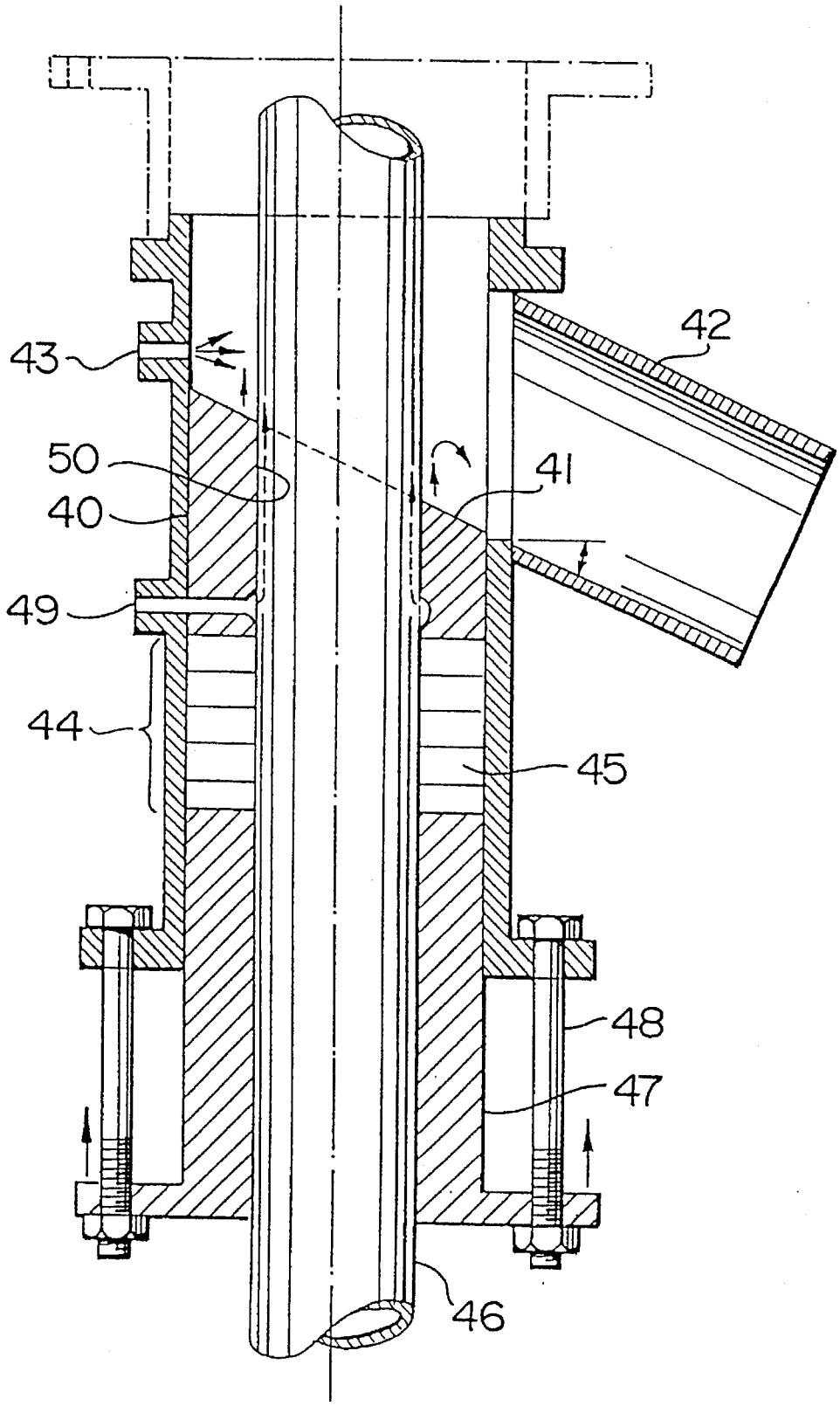

FIG. 5 illustrates a preferred preventor box for installation at the bottom of a borehole between a working gallery and the deposit. The borehole is preferably partially cased. The preventor box gives passage to the drilling rods and drains out the fragmented mineral and flushing fluid as a slurry. The solids of the slurry may be hazardous, abrasive or toxic, eg. radioactive, so the preventor box is designed to minimize leakage of the slurry. The preventor box is also designed to control borehole pressure that may result from location of the deposit near an aquifer, with possible connections to the borehole, or in water or gas strata under considerable pressure.

FIG. 5 shows the preventor box which includes an upper guide and retainer bushing 40 with an upper inclined surface 41 to assist drainage of the slurry into the slurry outlet 42. This inclined surface feature also helps to prevent back-pressure on the slurry, water and other fluids. Opposite to the slurry outlet and close to the higher side of the upper inclined surface of the retainer bushing is provided a booster fluid inflow conduit 43 to assist drainage of the slurry and to build a fluid seal above the retainer bushing.

A seal package 44 is provided below the retainer bushing. The package is comprised of seal segments 45 around the drilling rod 46. The segments can be compressed and submitted to controlled wear. Preferably, the segments are made of woven fibers embedded in grease, which is released during compression. Controlled wear of the segments is compensated by adding new segments through the bottom of the preventor box, ie. by removal of the piston-type lower bushing 47. The lower bushing can be downwardly removed from, or upwardly moved in, the preventor box by action of the tensioning bolts 48. Upward movement produces pressure on the seal package.

The preventor box also includes a seal fluid entry 49 with an outer annulus and radial holes connected to an inner annulus around the drilling rod. Seal fluid injected causes pressure to build up against the drilling rod and seal package, thereby stopping migration of slurry downwards and draining slurry leakages back to the inclined surface of the retainer bushing (see arrow 50). If any deficiency of the seal package occurs, only clean seal water may leak out from the preventor.

Although the present invention has been described herein with reference to preferred embodiments, such as shown in the Figures, it will be apparent to any skilled person in the art that variations of such embodiments may be made that are within the scope of the invention.

What is claimed:

1. A jet boring pre-assembly, for assembly and use in excavating an underground area susceptible to disaggregation by high pressure fluid jet and for control from a working gallery below said area, comprising:

a cutting head for a top of the assembly, said head having a jet boring fluid conduit for delivery of high pressure jet boring fluid to at least one high pressure fluid nozzle, and a flushing fluid conduit for delivery of low pressure flushing fluid to at least one flushing fluid nozzle;

a dual conduit drilling rod for locating in a borehole beneath said cutting head, said rod having a jet boring fluid conduit for delivery of said jet boring fluid to the jet boring fluid conduit of said cutting head, and a flushing fluid conduit for delivery of said low pressure flushing fluid to the flushing fluid conduit of said cutting head; and a preventor box for sealing a lower end of said borehole and having a passage therethrough for said drilling rod, said preventor box including sealing means for between an inner wall of the preventor box and an outer wall of said drilling rod whereby said drilling rod may be operated while maintaining a seal of said sealing means, means for receiving a slurry of excavated material and flushing fluid exiting a bottom of the borehole, and an outlet for said slurry.

2. The pre-assembly of claim 1 wherein the cutting head includes a plurality of augers adapted to assist movement of said slurry into the borehole when said augers are in flight during rotation of the cutting head.

3. The pre-assembly of claim 2 in which at least one of said nozzles is in an auger spiral protected position adjacent one of said augers for reduced abrasion.

4. The pre-assembly of claim 2 in which the high pressure fluid nozzle is in an auger spiral protected position adjacent one of said augers to maximize jet boring fluid action diameter and reduce abrasion.

5. The pre-assembly of claim 1 which additionally includes a dual-conduit auger rod for use between the cutting head and the dual-conduit drilling rod, said auger rod including a jet boring fluid conduit for delivering said jet boring fluid from said jet boring fluid conduit of the dual-conduit drilling rod to said jet boring fluid conduit of the cutting head, a flushing fluid conduit for delivering said low pressure flushing fluid from said flushing fluid conduit of the dual-conduit drilling rod to said flushing fluid conduit of the cutting head and to at least one flushing fluid nozzle on the auger rod, and a plurality of augers adapted, when in flight during rotation of the auger rod, to assist movement of said slurry into the borehole.

6. The pre-assembly of claim 5 wherein the cutter head is for sealed connection to the auger rod by a slip-on coupling and coupling locking means.

7. The pre-assembly of claim 6 wherein one of the cutter head and the auger rod has a non-cylindrical male connector end and the other has a non-cylindrical female connector end, the male connector end and female connector end respectively adapted for mating engagement to form the coupling.

8. The pre-assembly of claim 7 wherein the mating surfaces of the male and female connector ends are respectively hexagonal in transverse cross-section.

9. The pre-assembly of claim 1 wherein the cutting head is adapted to support a cutting bit for mechanical cutting action on said material.

10. The pre-assembly of claim 1 wherein said jet boring fluid conduits of the drilling rod and cutting head are contained by said flushing conduits of the cutting head and drilling rod respectively.

11. The pre-assembly of claim 10 wherein said jet boring fluid conduits are spaced apart from inside walls of said flushing fluid conduits by a plurality of spacers.

12. The pre-assembly of claim 1 wherein the sealing means includes a lower bushing, an upper retainer/guide bushing, and a seal between said bushings.

13. The pre-assembly of claim 12 wherein the upper bushing is adapted at an upper surface thereof to assist flow of said slurry into said slurry outlet.

14. The pre-assembly of claim 13 in which the upper surface of said upper bushing is inclined towards said slurry outlet.

15. The pre-assembly of claim 12 in which said lower bushing is a piston-type bushing for selective transverse movement by action of associated tightener means.

16. The pre-assembly of claim 12 in which the seal comprises a plurality of compressible seal segments.

17. The pre-assembly of claim 1 wherein a booster fluid inflow conduit is provided, adjacent an area of said preventor box for receiving said slurry, for delivery of booster fluid into said area to assist flow of said slurry into said slurry outlet.

18. The pre-assembly of claim 1 wherein said preventor box includes a sealing fluid delivery means for delivery of sealing fluid to said sealing means and outer surface of the drilling rod.

* * * * *